US006225543B1

(12) United States Patent
Miguel

(10) Patent No.: US 6,225,543 B1
(45) Date of Patent: May 1, 2001

(54) DEVICE WITH PEDAL FOR AT LEAST TWO PERCUSSION INSTRUMENTS

(76) Inventor: Jean-François Miguel, 24, avenue Max Dormoy, 03100 Montlucon (FR)

( * ) Notice: Subject to any disclaimer, the term of this patent is extended or adjusted under 35 U.S.C. 154(b) by 0 days.

(21) Appl. No.: 09/380,277

(22) PCT Filed: Feb. 27, 1998

(86) PCT No.: PCT/FR98/00386

§ 371 Date: Aug. 27, 1999

§ 102(e) Date: Aug. 27, 1999

(87) PCT Pub. No.: WO98/38628

PCT Pub. Date: Sep. 3, 1998

(30) Foreign Application Priority Data

Feb. 28, 1997 (FR) ..... 97 02456

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS

| | | | | |
|---|---|---|---|---|
| 4,520,710 | * | 6/1985 | Elliott, Jr. | 84/422 R |
| 5,355,761 | * | 10/1994 | Ward et al. | 84/422.2 |
| 6,011,208 | * | 1/2000 | Hoshino | 84/422.1 |
| 6,031,170 | * | 2/2000 | Hoshino | 84/422.3 |
| 6,049,032 | * | 4/2000 | Liao | 84/422.3 |

* cited by examiner

*Primary Examiner*—Robert E. Nappi
*Assistant Examiner*—Kim Lockett
(74) *Attorney, Agent, or Firm*—Larson & Taylor PLC

(57) ABSTRACT

A device with pedal (2), and a method for using a device with pedal, for at least two percussion instruments such as a base drum and "Charleston" cymbal, includes a support base of at least two mobile parts, for the percussion of each of the two instruments respectively. The device also includes a single pedal (2) for actuating the mobile parts. The pedal has a first end (11), for resting the user's heel on the ground, which first end is mounted doubly pivoting about a horizontal axis (13) and a vertical axis (15), and a second end (20) provided to co-operate with a device (22) arranged to enable the user to acuate alternately the mobile parts.

10 Claims, 4 Drawing Sheets

DEVICE WITH PEDAL FOR AT LEAST TWO PERCUSSION INSTRUMENTS

The present invention relates to a device having a pedal for actuating at least two percussion instruments, such as bass drum and cymbal.

It has a particularly important although not exclusive application in the field of double bass drum pedals for a percussion section.

A plurality of double bass drum pedal systems are already known, this accessory having indeed become essential to modern percussionists.

The principal disadvantage arises from the need to move the whole of the user's foot between the pedal which actuates, for example, the cymbals known as "Charleston" and that which actuates the bass drum.

This gives rise first to increased fatigue on the part of the percussionist and secondly to possible imperfections in the musical effect, having regard to the delay time involved by this need for the user's foot to be physically moved.

Also known (GB-A-275,499) is a device having a single pedal employing a transverse rod for the alternative or simultaneous lateral control of two instruments.

Such a device lacks precision.

The object of the present invention is to provide a device which meets practical requirements better than those previously known, especially in that it permits the effort by the percussionist to be minimized. It additionally permits greater fluidity, comfort and speed of execution for the user of the double bass drum and/or other instruments of the cymbal type known as "Charleston".

A cymbal known as "Charleston" is a movable cymbal actuated vertically by a pedal arrangement in order to strike a second cymbal which is itself solidly fixed to said pedal arrangement.

To this end, the invention essentially proposes a device having a pedal, for at least two percussion instruments such as bass drum and cymbal, characterized in that it comprises a support pedestal formed from at least two moving pieces, respectively for striking each of said instruments, and in that it comprises only a single pedal for actuating said moving pieces, said pedal having a first end for supporting the heel of a user on the ground, said end being mounted in a doubly pivoting manner about a horizontal axis and vertical axis, and a second end provided with means suitable for interacting with means arranged so as to permit the user to actuate said moving pieces alternatively.

In advantageous forms of embodiment, furthermore, use is made of one and/or the other of the following arrangements:

- the means suitable for interacting comprise a cylindrical tip of a rigid and sliding material, situated to project relative to, and in the extension of, the second end of the pedal;
- the cylindrical tip is formed by a removable sleeve which is movable in rotation about its axis;
- the means arranged to enable the moving pieces to be actuated alternatively comprise, for each moving piece, a system capable of displacing said piece between a position of rest, entirely away from the instrument, and an instrument contact or percussion position, said system having means for automatically restoring the piece to the position of rest;
- each system possesses means for guiding the tip in the vertical plane comprising a stirrup solidly fixed to the moving piece, each stirrup being symmetrical with the other relative to a vertical plane, and being provided on one side with a socket for receiving the tip situated between the two stirrups, and on the other side with at least one groove for guiding said stirrup on a rail arranged to guide said stirrup in the vertical plane between said position of rest of the moving piece, completely away from the instrument, and said position of contact or percussion with the instrument;
- the rails are in the form of a bow having a radius of curvature whose axis is merged with the horizontal axis of the pedal;
- the two systems are separated from one another by a separation fitting whose upper part is rounded and situated at a height slightly greater than that of the lower lips of the sockets of said stirrups when the latter are in the position of rest, said upper part being arranged to permit the passage of the tip by lateral pivoting of the pedal about its vertical axis by sliding one socket toward the other, slightly relaxing the bearing of the user's foot on the pedal while causing it to pivot by bearing on the heel in contact with the first end of said pedal;
- the fitting is mounted to slide on a support between a position allowing alternative actuation of the two instruments and a position for locking the device in an actuating position of one of said instruments only;
- the two systems are directly adjacent to one another, the lower lips of the sockets of said stirrups when the latter are in the position of rest being face to face and being arranged so as to permit the passage of the tip by lateral pivoting of the pedal about its vertical axis by sliding one socket toward the other, slightly relaxing the bearing of the user's foot on the pedal while causing it to pivot by bearing on the heel in contact with the first end of said pedal;
- the angle of pivoting of the pedal about its vertical axis is between 3° and 15°;
- one of the systems is arranged to actuate a cymbal which is movable relative to a fixed cymbal, by actuation of a rod for displacing said movable cymbal relative to said fixed cymbal.

The invention also proposes a method for operating at least two percussion instruments such as bass drum and cymbal, by actuation of a pedal, characterized in that, at least two moving pieces, respectively for the percussion of each of said instruments, are actuated respectively and successively, depending on the music being played, by means of a single pedal for actuation of said moving pieces, by lateral pivoting of said pedal about a vertical axis through a predetermined angle between a first position for actuation of a first moving piece and a second position for actuation of a second moving piece.

Equally advantageously, the predetermined angle is between 3° and 15°.

In another advantageous form of embodiment, the lateral pivoting of the pedal about its vertical axis is undertaken by sliding from one position to the other, slightly relaxing the bearing of the user's foot on the pedal while causing it to pivot by bearing on the heel in contact with the first end of said pedal.

The invention will be better understood from a reading of the description of two forms of embodiment given below by way of non-limiting example.

The description refers to the drawings which accompany it, wherein.

Figure 1:
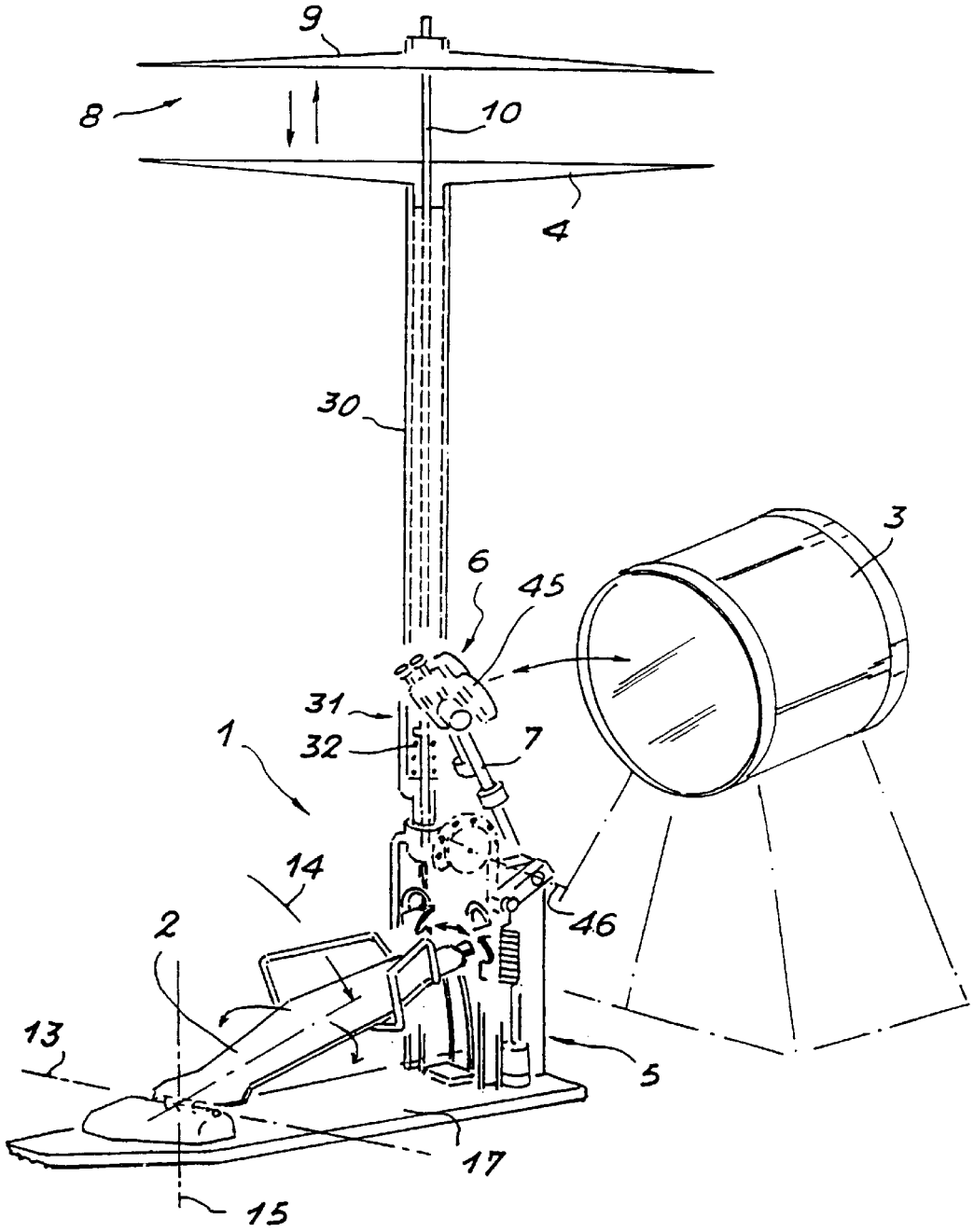
FIG. 1 is a perspective view of a device according to a first form of embodiment of the invention provided with moving pieces for the percussion playing of a bass drum and a fixed cymbal.

FIG. 1 shows a device 1 having a pedal 2 for a bass drum 3 and cymbal 4, comprising a support pedestal 5 for a first moving piece 6 comprising a lever arm 7 arranged to move in rotation between a position of rest and a position of contact of the piece 6 with the bass drum 3, and a second moving piece 8 comprising a cymbal 9 which is movable relative to the fixed cymbal 4 and possesses an actuating rod 10 solidly fixed to said cymbal 9 which is arranged in order to move vertically between a position of rest away from and a position of contact with the fixed cymbal 4 when the pedal is in the low position.

More specifically, and again with reference to FIGS. 2, 3 and 4, the device 1 according to the invention possesses only a single actuating pedal 2 in the form of a plate for the support of a shoe sole, provided with a non-skid surface 2', such as for example non-skid tapes of a known type.

The pedal comprises a first end 11 connected to a rectangular or substantially rectangular block 12 by a horizontal pivot pin 13 (arrow 14) about which the pedal pivots in the vertical plane between a high position of rest and a low position of percussion actuation.

The block, for its part, is mounted to pivot with gentle friction about a vertical axle 15 solidly fixed to an end portion 16 of a plate 17 for supporting the device 1 on the ground. The other end portion 18 of the plate 17 is rigidly fixed to the foot 19 of the support pedestal 5.

The pedal possesses a second end 20 provided with means 21 suitable for interacting with the means 22 arranged to enable the user to actuate the moving pieces 6 and 8 alternatively via the foot (not shown).

The means 21 suitable for interaction comprise a cylindrical tip 23 of rigid and sliding material, for example the plastic known under the name Teflon, situated projecting relative to and in the extension of the second end 20 of the pedal.

Here, the cylindrical tip is formed by a removable sleeve which is movable in rotation about its axis, secured by a nut 24.

The nut 24 makes it possible for the sleeve to be tightened to a greater or lesser extent on the supporting bolt solidly fixed to the end of the pedal, enabling more or less easy rotation of said sleeve about its axis.

When the nut 24 is removed, the sleeve can then be removed and replaced with a new sleeve of unworn Teflon.

The support pedestal 5 consists, for example, of an open frame 25 integrally cast in stainless steel, between the legs 26 of which are located the means 21 suitable for interacting with the means 22 arranged to allow the actuation of the pieces.

The central part 27 of the open frame 25 supports and guides the moving pieces 6 and 8.

The means 22 arranged to make it possible to actuate said moving pieces alternately each comprise a system 28, 29 (cf. FIG. 3) arranged to displace the piece between the position of rest, completely away from the instrument, and a position of contact with the instrument.

More specifically, the system 28 in the case of the cymbal is situated on one side of the open frame in the vicinity of a leg 26.

It comprises a column 30 for guiding the rod 10 which possesses, in a manner known per se, an internal device 31 having a spring 32 (see FIG. 1) automatically moving the movable upper cymbal upwards unless causing it to descend by means of the pedal to strike the fixed cymbal 4 solidly fixed to the column 30.

Let it be recalled that in a pedal cymbal, in order for the performance of the piece of music by the performer to be expressed accurately, it is necessary for the movable cymbal to be capable of being actuated at high speed and with great precision, in other words that it is necessary to have a very acute response.

As regards the mechanism, this acuteness of response is obtained when it is sufficient to apply light force to the pedal and when the pedal is rapidly restored to the initial position in which the cymbals are at a distance apart.

Given that the control rod is subject to a constant upward stress as a result of the spring, an adjusted resistance spring will be used so that it is sufficient to press the pedal lightly in order to obtain the desired result, which is permitted by the device according to the form of embodiment of the invention more specifically described here.

The system 28 comprises means 33 for receiving, guiding and transversely locking the tip 21 in the vertical plane, comprising a stirrup 34 solidly fixed to the end 35 of the rod 10 by means of an articulation piece 36.

This piece makes it possible to recover the slight axial offset relative to the rod 10 during the actuation of the pedal, the end of which describes an arc of a circle.

The rod is held rigidly transversely relative to the beam 27 of the open frame, which supports the column 30 for axial guidance of said rod.

The stirrup 34 possesses, on a lateral side situated on the side of the tip 21, a socket 37 for receiving the tip, in the form of a slide provided with a vertical lateral aperture 38 and with a throat 39 for receiving and laterally retaining the tip by means of the lower lip 40 of said slide or socket, facing toward the center of the open frame.

The depth of the throat and the rounded and projecting form of the lower lip are arranged so as to permit easy release of the tip by lateral pivoting as soon as the pressure on the pedal is released and a light transverse motion is imparted to said pedal.

Similarly, the upper part 41 of the socket is rounded, again to permit easy release and lateral guidance of the tip when the pressure on the pedal is to be reduced.

The stirrup 34 comprises on the other side two grooves 42 for guidance by a cylindrical rail 43 in the shape of a bow or branch, the plane of which is parallel to the longitudinal axis 44 of the pedal, and the foot of which, formed by the two ends of the bow, is solidly fixed to the end 18 of the plate 17, under the open frame 25.

More specifically, the rail 43 is made, for example, from stainless steel and possesses two legs in the shape of an arcuate spring clip, each interacting with gentle friction with a curved groove 42, said legs and said grooves having a radius of curvature $\rho$ whose axis is merged with the horizontal axis 13 of the pedal.

The stirrup 34 is made, for example, from a material known by the name Teflon, which permits easy sliding on the arcuate spring clips without untimely friction.

The second system 29 is situated on the other side of the open frame and, for its part, allows the actuation of the lever arm 7 provided on one side with a tip or shoe 45 for the percussion of the bass drum and, solidly fixed to the other side, with a horizontal pivot pin 46 articulated to rotate on the upper part of the leg 26' of the open frame.

The lever arm is rigidly and solidly fixed to a lug 47 via the pivot pin 46, said lug being provided with a pin 48 which is external relative to the open frame and axially offset relative to the pivot pin 46.

The pin 48 is connected to the end 49 of a helical spring 50 whose other end 51 is fixed, so as to be adjustable in height, to the lower part of the leg 26' to permit changes in the tension of the spring.

Figure 2:
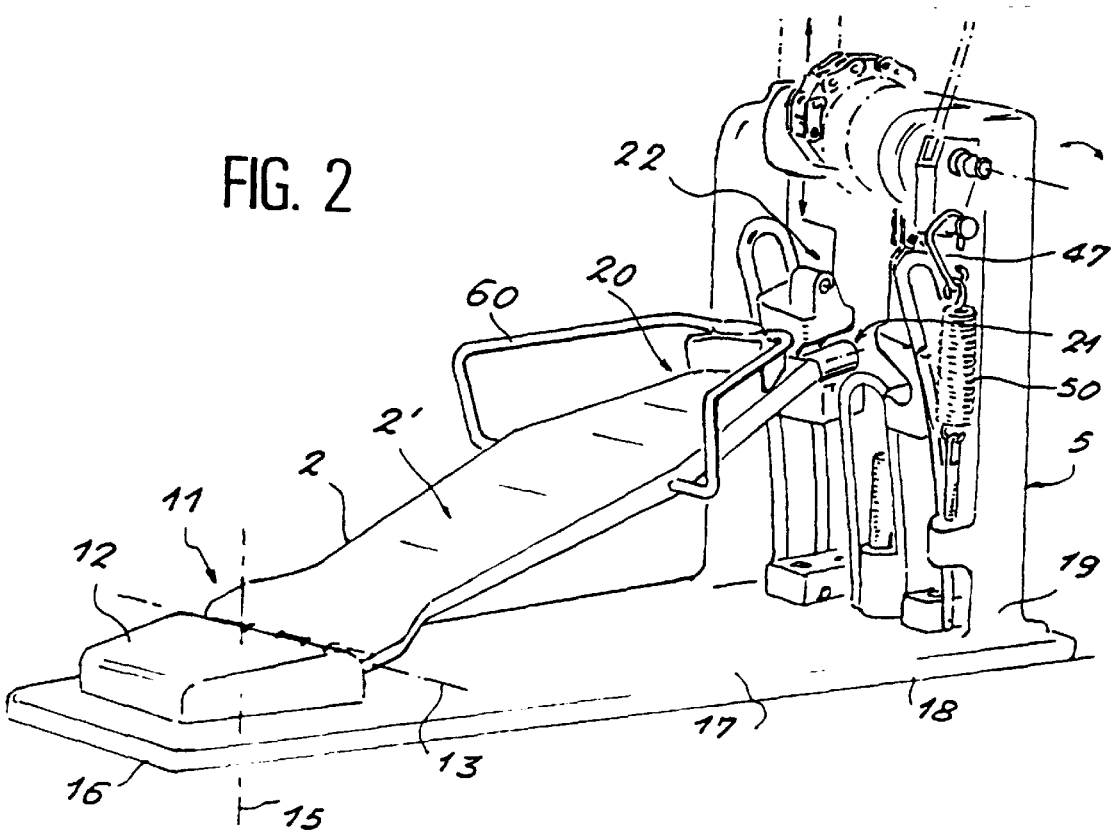
FIG. 2 is a perspective view on a larger scale of the device according to FIG. 1.

The lug 47 is arranged to be restored to the position of rest by the spring 50 as shown in FIG. 2.

Furthermore, the pivot pin 46 is actuated in rotation by means of a running chain 52 of the bicycle chain type whose end 53 is solidly fixed to a stirrup 34' and which, moreover, engages on a toothed wheel (not shown), fixed in rotation with said pivot pin 46.

The system 29 is symmetrical with the system 28 relative to a central, longitudinal and vertical plane 54 of the device.

The system 29 is identical to the system 28 described more specifically above and will therefore not be described in detail.

In the form of embodiment more specifically described here, with reference to FIGS. 1 to 4, the two systems 28 and 29 are separated from one another by a fitting 55 in the shape of a bow, fixed by both its ends to the plate 17 and having a rounded upper part 56 situated at a slightly greater height, for example from 1 to 3 mm greater, than that of the lower lips 40, 40' of the sockets of the stirrups when the latter are in the position of rest, in other words raised, taking into account the restoring springs.

This upper part is arranged to permit the passage of the tip by lateral pivoting of the pedal about its vertical axis, allowing the sliding and/or rolling of the tip from one socket to the other.

The upper part 56 is, for example, likewise adjustable in height by displacement of the nut along a rod 57, which makes it possible, for example, to lock the device in one or the other of the two possible functions (actuation of the bass drum or of the cymbals) by causing the fitting 55 to slide along the rod.

Finally, in order to allow the lateral pivoting of the pedal and the transverse locking of the user's foot on the pedal during pivoting, means 60 are provided, for example in the form of a rod curved back at the end to serve as a side rail on the circumference of the pedal at its end 20.

The means 60 thus make it possible to lock the toe of the foot laterally.

Figure 3:
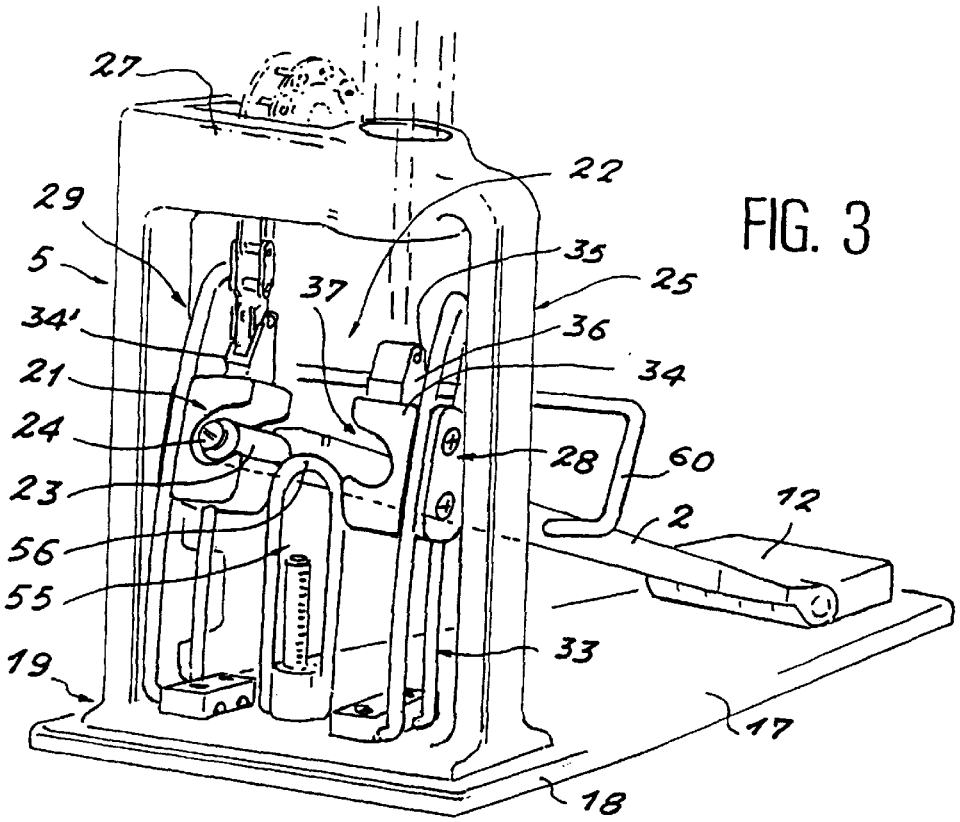
FIG. 3 is a perspective view from the rear of the device according to FIG. 2.
Figure 4:
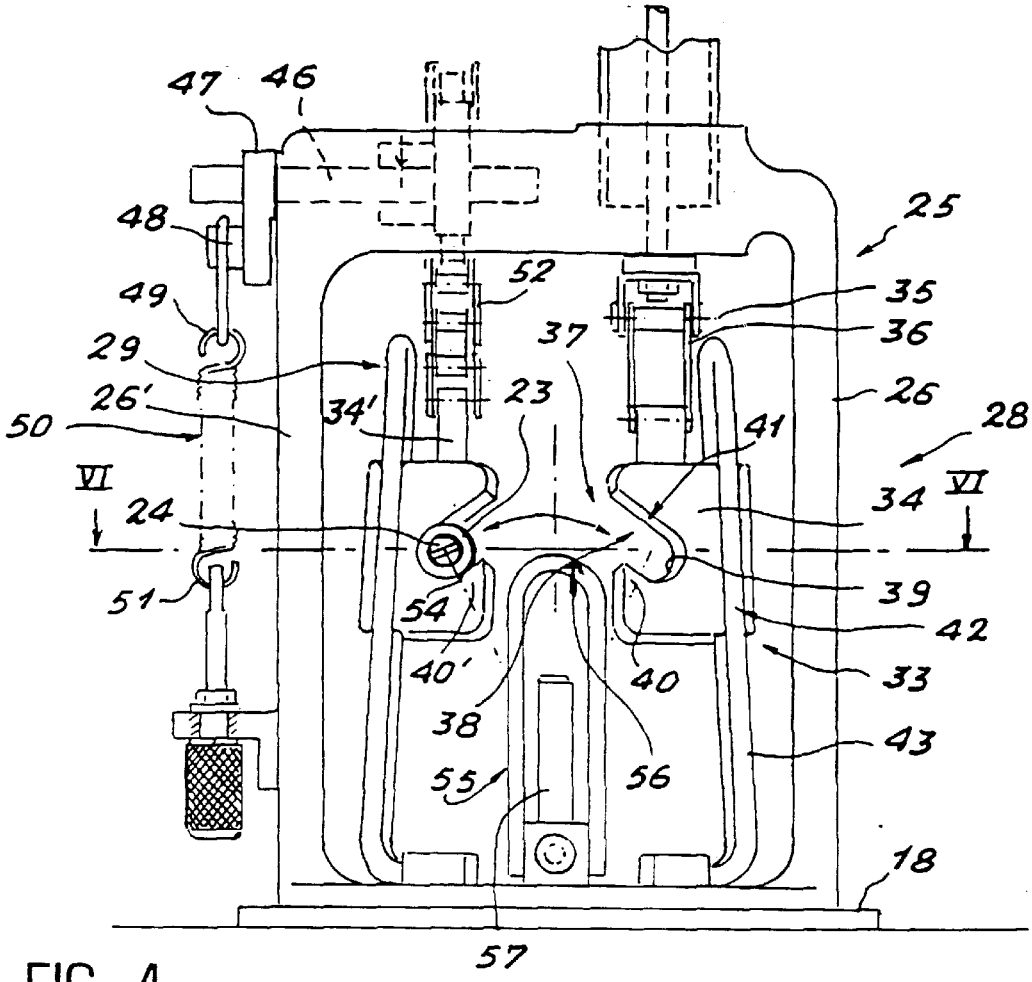
FIG. 4 is a rear elevation of the device according to FIG. 1.

The tip 23 can thus be driven to pivot by moving slightly upward and coming to slide on the upper lips of the two stirrups, via the upper part 56 which is thus rounded, as shown in FIG. 3, so as to change from the actuation of one moving piece to the other by sliding from one socket to the other.

The fitting 55 may be of more or less substantial width.

Figure 5:
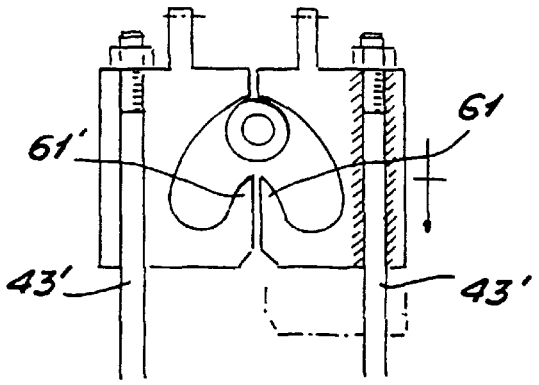
FIG. 5 is a partial elevation of the stirrups according to another form of embodiment of the invention.

In one form of embodiment (FIG. 5) it can even be omitted, the movement required in order to change over from one moving piece to the other being still further reduced, and the lower lips 61, 61' of the stirrups being opposite one another.

The rails 43' are in this case simple curved rods pointing in the upward direction and secured in the upper part by nuts.

Figure 6:
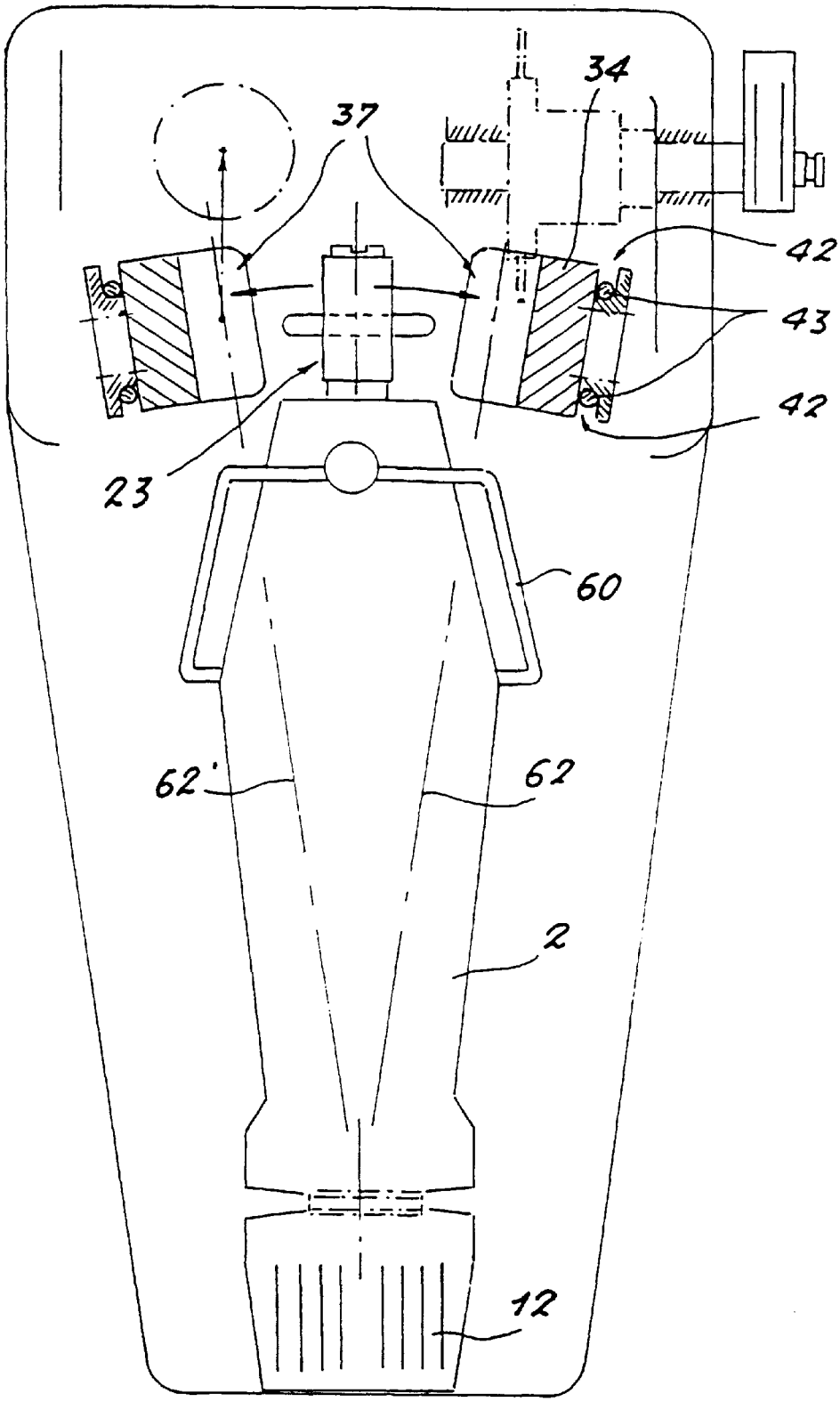
FIG. 6 is a sectional view along VI VI and from above of the pedal of the device according to FIGS. 1 to 4.

A description will now be given of the manner of use of the device according to the invention, more specifically described with reference, in particular, to FIG. 6.

The user places his foot (not shown) on the pedal 2 and successively actuates, depending on the music being played, either the cymbals or the bass drum by means of this pedal by laterally pivoting said pedal about its vertical axis 15 through the predetermined angle, for example set at 5°, between the first position 62 and the second position 63.

In order to do this, he relaxes and then applies a rotation of his foot about the support point formed by his heel, hooking the toe of the foot into the means 60, so as to change over from one position to the other.

When he wishes to actuate the selected instrument, he then bears on the pedal, which permits both flexible and accurate movements of the moving percussion pieces as a result of the shapes of the sockets which retain the tip sufficiently and the sliding means of the stirrups 34, 34', made from Teflon, whose lateral throats or grooves are suitable for sliding on the legs of the stainless steel bows.

As is self-evident, and as is moreover apparent from the foregoing, the present invention is not restricted to the forms of embodiment more specifically described.

To the contrary, it encompasses all variations thereof, and in particular the variation where three percussion instruments are actuated by the same pedal with an intermediate stirrup whose socket will thus be open on both sides, or those where the means for restoring the moving percussion pieces to the position of rest are different from those more specifically described here.

What is claimed is:

1. A Device having a pedal, for at least two percussion instruments such as bass drum and cymbal, comprising a support pedestal formed from at least two moving pieces, respectively for striking each of said instruments, a single pedal for actuating said moving pieces, said pedal having a first end for supporting the heel of the user on the ground, said first end being mounted in a doubly pivoting manner about a horizontal axis and vertical axis, and a second end provided with first means suitable for interacting alternatively with second separate means respectively connected to said moving pieces, said second means comprising, for each moving piece, a system capable of displacing said piece between a position of rest, entirely away from the instrument, and an instrument contact or percussion position, said system having means for automatically restoring the piece to the position of rest, wherein each system possesses guiding means for guiding the first means in the vertical plane, comprising a stirrup solidly fixed to the moving piece, each stirrup being symmetrical with the other relative to a vertical plane, and being provided on one side with a socket for receiving the first means situated between the two stirrups, and on the other side with at least one groove for guiding said stirrup on a rail arranged to guide said stirrup in the vertical plane between said position of rest of the moving piece, completely away from the instrument, and said position of contact or percussion with the instrument.

2. Device according to claim 1, wherein the first means comprise a cylindrical tip, situated to project relative to, and in the extension of, the second end of the pedal.

3. Device according to claim 2, wherein the tip is made from a rigid and sliding material.

4. Device according to claim 2, wherein the tip is formed by a removable sleeve which is movable in rotation about its axis.

5. Device according to claim 1, wherein the rails are in the form of a bow having a radius of curvature whose axis is merged with the horizontal axis of the pedal.

6. Device according to claim 2, wherein the two systems are separated from one another by a separation fitting whose upper part is rounded and situated at a height slightly greater than that of the lower lips of the sockets of said stirrups when the latter are in the position of rest, said upper part being arranged to permit the passage of the tip by lateral pivoting of the pedal about its vertical axis by sliding one socket toward the other, slightly relaxing the bearing of the user's foot on the pedal while causing it to pivot by bearing on the heel in contact with the first end of said pedal.

7. Device according to claim 6, wherein the fitting is mounted to slide on a support between a position allowing alternative actuation of the two instruments and a position for locking the device in an actuating position of one of said instruments only.

8. Device according to claim 2, wherein the two systems are directly adjacent to one another, the lower lips of the sockets of said stirrups when the latter are in the position of rest being face to face and being arranged so as to permit the passage of the tip by lateral pivoting of the pedal about its vertical axis by sliding one socket toward the other, slightly relaxing the bearing of the user's foot on the pedal while causing it to pivot by bearing on the heel in contact with the first end of said pedal.

9. Device according to claim 1, wherein the angle of pivoting of the pedal about its vertical axis is between 3° and 15°.

10. Device according to claim 1, wherein one of the systems is arranged to actuate a cymbal which is movable relative to a fixed cymbal, by actuation of a rod for displacing said movable cymbal relative to said fixed cymbal.

* * * * *